US011981875B2

(12) United States Patent
Perdomo et al.

(10) Patent No.: US 11,981,875 B2
(45) Date of Patent: May 14, 2024

(54) EROSION RESISTANT ALLOY FOR THERMAL CRACKING REACTORS

(71) Applicant: ExxonMobil Chemical Patents Inc., Baytown, TX (US)

(72) Inventors: Jorge J. Perdomo, Kingwood, TX (US); Ivan A. Morales, Houston, TX (US); Changmin Chun, Raritan, NJ (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 122 days.

(21) Appl. No.: 17/311,132

(22) PCT Filed: Dec. 13, 2019

(86) PCT No.: PCT/US2019/066119

§ 371 (c)(1),
(2) Date: Jun. 4, 2021

(87) PCT Pub. No.: WO2020/131596

PCT Pub. Date: Jun. 25, 2020

(65) Prior Publication Data

US 2022/0017827 A1 Jan. 20, 2022

Related U.S. Application Data

(60) Provisional application No. 62/783,002, filed on Dec. 20, 2018.

(51) Int. Cl.
*C22C 30/00* (2006.01)
*C10G 9/20* (2006.01)

(52) U.S. Cl.
CPC ..... *C10G 9/203* (2013.01); *C22C 30/00* (2013.01)

(58) Field of Classification Search
CPC ..... C10G 9/203; C22C 30/00; C22C 19/05; C22C 19/053
(Continued)

(56) References Cited

U.S. PATENT DOCUMENTS 3,698,878 A 10/1972 Hale
3,758,294 A 9/1973 Bellot et al.
(Continued)

FOREIGN PATENT DOCUMENTS

CN 1392280 1/2003
EP 3533889 9/2019
(Continued)

OTHER PUBLICATIONS

A. V. Levy, "Mechanisms of Erosion," Solid Particle Erosion and Erosion-Corrosion of Materials, ASM International, Materials Park, OH, pp. 11-33, 1995.
(Continued)

*Primary Examiner* — Prem C Singh
*Assistant Examiner* — Francis C Campanell

(57) ABSTRACT

Reactor components formed using an erosion resistant alloy having desirable high temperature mechanical strength are provided. The erosion resistant components can include, but are not limited to, tubes, reactors walls, fittings, and/or other components having surfaces that can be exposed to a high temperature reaction environment in the presence of hydrocarbons and/or that can provide pressure containment functionality in processes for upgrading hydrocarbons in a high temperature reaction environment. The erosion resistant alloy used for forming the erosion resistant component can include 42.0 to 46.0 wt. % nickel; 32.1 to 35.2 wt. % chromium; 0.5 to 2.9 wt. % carbon; 0 to 2.0 wt. % titanium; 0 to 4.0 wt. % tungsten, and iron, with at least one of titanium and tungsten is present in an amount of 1.0 wt. %
(Continued)

or more. The iron can correspond to the balance of the composition. Optionally, the erosion resistant alloy can provide further improved properties based on the presence of at least one strengthening mechanism within the alloy, such as a carbide strengthening mechanism, a solid solution strengthening mechanism, a gamma prime strengthening mechanism, or a combination thereof.

25 Claims, 1 Drawing Sheet

(58) Field of Classification Search
USPC ..... 208/132
See application file for complete search history.

(56) References Cited

U.S. PATENT DOCUMENTS

| | | | |
|---|---|---|---|
| 3,816,081 | A | 6/1974 | Hale |
| 3,826,689 | A | 7/1974 | Ohta et al. |
| 4,063,934 | A | 12/1977 | Thuillier et al. |
| 4,388,125 | A | 6/1983 | Benn |
| 4,582,681 | A | 4/1986 | Asari et al. |
| 5,302,181 | A | 4/1994 | Morichika et al. |
| 5,316,721 | A | 5/1994 | Sugitani et al. |
| 6,093,260 | A | 7/2000 | Petrone et al. |
| 6,231,807 | B1 | 5/2001 | Berglund |
| 6,268,067 | B1 | 7/2001 | Petrone et al. |
| 9,296,666 | B2 | 3/2016 | Spicer et al. |
| 10,041,152 | B2 | 8/2018 | Kirchheiner et al. |
| 11,136,655 | B2 | 10/2021 | Hashimoto et al. |
| 2009/0053100 | A1 | 2/2009 | Pankiw et al. |
| 2011/0272070 | A1* | 11/2011 | Jakobi ..... C22C 19/05 420/586 |
| 2014/0257001 | A1 | 9/2014 | Spicer et al. |
| 2018/0037979 | A1 | 2/2018 | Bratland |

FOREIGN PATENT DOCUMENTS

| | | | |
|---|---|---|---|
| GB | 608858 | A * | 3/1945 |
| JP | H0297642 | | 4/1990 |
| JP | H05239599 | A | 9/1993 |
| WO | 2018/079073 | | 5/2018 |

OTHER PUBLICATIONS

J. L. Routbort and R. O. Scattergood, "Solid Particle Erosion of Ceramics and Ceramic Composites," Key Eng. Mater., 71 23-50 (1992).

Petrochemical Translation Collections Collection VI Cracking of Petroleum Hydrocarbons (II), translated by Beijing Petrochemical Company and et al, Petrochemical Industry Press, $1_{st}$ Edition, Jul. 1976, pp. 124-135.

* cited by examiner

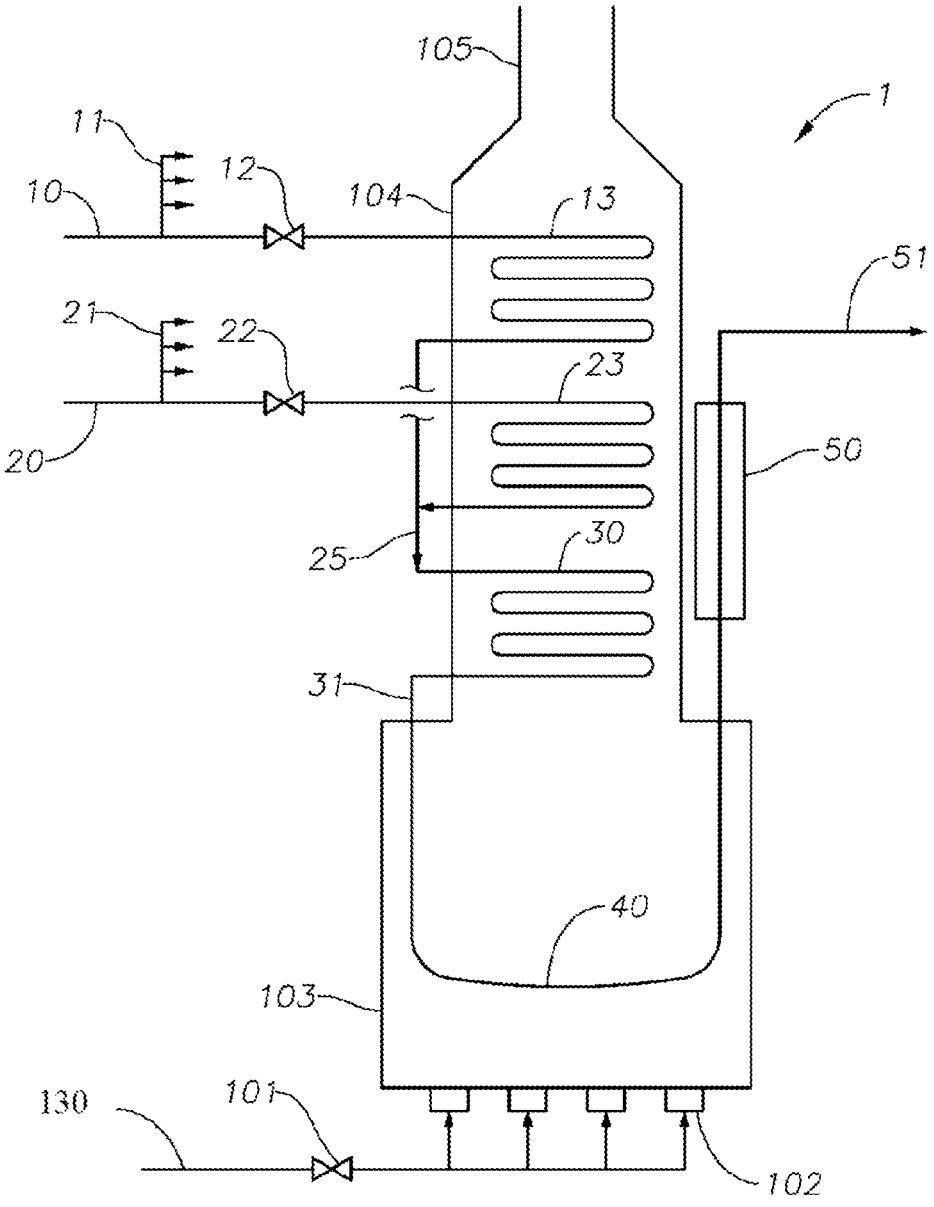
105
1
11
12
10
104
13
51
21
22
23
20
50
25
30
31
40
103
130
101
102

EROSION RESISTANT ALLOY FOR THERMAL CRACKING REACTORS

CROSS-REFERENCE TO RELATED APPLICATIONS

This application is a US national phase application of PCT Application Serial No. PCT/US2019/066119 having a filing date of Dec. 13, 2019, which claims priority to and the benefit of U.S. Provisional Application No. 62/783,002, having a filing date of Dec. 20, 2018, the disclosures of both of which are incorporated herein by reference in their entireties.

FIELD

This application relates to a high temperature alloy and its use in equipment for thermal cracking of hydrocarbon feeds, such as thermal cracking in furnaces.

BACKGROUND

Thermal cracking or pyrolysis of hydrocarbon feeds, such as thermal cracking hydrocarbon feeds in the presence of steam ("steam cracking"), is a commercially important technology for producing light olefins such as ethylene, propylene, and butadiene. Typical hydrocarbon feeds include, e.g., one or more of ethane and propane, naphtha, heavy gas oils, crude oil, etc. Thermal cracking furnaces generally include a radiant section containing at least one heat transfer tube and at least one burner for heating the hydrocarbon feed. When the heat transfer tubes in the radiant section are arranged in coils, it is typical to call these "radiant coils".

In one conventional thermal cracking process, a hydrocarbon and steam mixture is indirectly heated in at least one radiant section heat transfer tube ("radiant tube"), primarily by the transfer of heat from one or more burners to the radiant tube's exterior surface, e.g., radiant heat transfer from flames and high temperature flue gas produced in one or more burners, radiant heat transfer from the interior surfaces of a firebox enclosure, convective heat transfer from combustion gases traversing the radiant section, etc. The transferred heat rapidly raises the temperature of the hydrocarbon feed to the desired coil outlet temperature (COT), which typically ranges from about 1450° F. (788° C.) for some very heavy gas oil feeds to about 1650° F. (899° C.) or even 1700° F. (927° C.) for ethane or propane feeds.

Heat transferred to the hydrocarbon feed located in one or more of the radiant tubes results in thermal cracking of at least a portion of the hydrocarbon to produce a radiant coil effluent comprising molecular hydrogen, light olefin, other hydrocarbon byproducts, unreacted steam (if the thermal cracking is steam cracking), and unreacted hydrocarbon feed. Transfer line piping is typically utilized for conveying radiant coil effluent from the radiant section to a quenching stage. Coke accumulates during the thermal cracking on internal surfaces of the radiant tubes. After an undesirable amount of coke has accumulated, a flow of decoking mixture, typically an air-steam mixture, is substituted for the hydrocarbon+steam mixture for removing accumulated coke. Decoking effluent is conducted away. Following coke removal, the flow of hydrocarbon feed is restored to the decoked tubes. The process continues, with alternating pyrolysis (thermal cracking) mode and decoking mode. The radiant tubes experience significant mechanical stress as they expand and contract between the alternating cracking and decoking process modes. Several furnace components undergo erosion during decoking mode while carbon particles are transported at relatively high velocities causing metal loss over time.

Selectivity to light olefins during pyrolysis mode is favored by short contact time, high temperatures, and low hydrocarbon partial pressures. For this reason, radiant tubes and/or other radiant components typically operate at a temperature (measured at the tube metal) as high as 2050° F. (1121° C.). Radiant components are therefore manufactured from alloys having desirable properties at high temperature, such as high creep-strength and high rupture-strength. This can limit the available options for manufacture, as many commercial-grade erosion resistant alloys do not have adequate strength at temperature and/or weldability. Since the tubes are exposed to a carburizing environment during hydrocarbon pyrolysis, the alloy is typically also carburization resistant. And since the tubes are exposed to an oxidizing environment during decoking, the alloy is also typically oxidation resistant. Conventional heat transfer tube alloys include austenitic Fe—Cr—Ni heat resistant steels having variations of steam cracker alloys based on a composition having 25 wt. % chromium and 35 wt. % nickel (referred to as a "25 Cr/35 Ni alloy"), or a composition having 35 wt. % chromium and 45 wt. % nickel (referred to as a "35 Cr/45 Ni alloy") both with carbon in the order of 0.1 to 0.5 wt. %. It is conventional to employ differing compositions of minor alloying elements, for example, silicon, in order to enhance high temperature strength and/or carburization resistance. Carbon and other carbide former elements on these alloys are controlled to provide creep strength and weldability.

In conventional steam cracker alloys, $Cr_3C_2$, $Cr_7C_3$, and/or $Cr_{23}C_6$ form during aging at the operating conditions. This stems primarily from the abundant amount of chromium and carbon in the alloy. The presence of such phases during aging cause an increase in hardness and, depending on the carbon content, creep strength at temperature at the expense of weldability which results in cracking. Therefore, limiting the amount of carbon that can be introduced to improve hardness alone.

In an attempt to overcome this difficulty, components that are susceptible to erosion can be made with thicker erosion allowances to lengthen the life in service. Another common way to overcome erosion problems is to use erosion resistant alloys bonded to the material that suffers erosion. U.S. Pat. No. 3,816,081 discloses an example of an abrasion resistant alloy using a mixture of tungsten, titanium, tantalum, or pure titanium carbides. However, these carbides are embedded in a relatively soft matrix, which at the temperatures of thermal cracking furnaces, causes the early loss of the abrasion resistant overlay.

U.S. Pat. No. 5,302,181 describes a chromium-based, oxidation resistant, heat resistant alloy manufactured via sintering. By the use of a solid state diffusion process like sintering, which does not involve melting and solidification, the chemistry of the alloy can be adjusted to take a large amount of alloying elements. This can increase the hardness at temperature, but could otherwise cause cracking during solidification of castings and welds.

U.S. Pat. No. 6,268,067 B1 discloses increasing a tube's carburization resistance by employing a solid state pack diffusion surface treatment process of an alloy containing 5 to 15 wt. % aluminum. The reference discloses a tube structure wherein the specific alloy content of one or more elements on the surface of a tubular member can be increased to a certain depth to improve carburization resistance. However, the enriched-layer depth construction of these components is economically demanding and has limited erosion life as it is not monolithic.

U.S. Pat. No. 10,041,152 describes a thermostable and corrosion-resistant cast nickel-chromium alloy. The alloy includes 0.5 wt. % to 13 wt. % of iron, less than 0.8 wt. % carbon, and 1.5 wt % to 7 wt. % of aluminum. The alloy can also include up to 1 wt. % silicon, up to 0.2 wt. % manganese, 15 wt. % to 40 wt. % chromium, up to 2.5 wt. % niobium, up to 1.5 wt. % titanium, 0.01 wt. % to 0.4 wt. % zirconium, up to 0.06 wt. % nitrogen, up to 12 wt. % cobalt, up to 5 wt. % molybdenum, up to 6 wt. % tungsten, 0.01 wt. % to 0.1 wt. % yttrium, with the balance corresponding to nickel.

Thus, there remains a need for a monolithic heat resistant and erosion resistant alloy for use in thermal cracking environments.

SUMMARY

In various aspects, reactor components formed using an erosion resistant alloy having desirable high temperature mechanical strength (heat resistant) are provided. The erosion resistant components can include, but are not limited to, tubes, reactors walls, fittings, and/or other components having surfaces that can be exposed to a high temperature reaction environment in the presence of hydrocarbons and/or that can provide pressure containment functionality (among other functionalities, if any) in processes for upgrading hydrocarbons in a high temperature reaction environment. The erosion resistant alloy used for forming the erosion resistant component can include 42.0 to 46.0 wt. % nickel; 32.1 to 35.2 wt. % chromium; 0.5 to 2.9 wt. % carbon; 0 to 2.0 wt. % titanium; 0 to 4.0 wt. % tungsten, and balance iron, with at least one of titanium and tungsten is present in an amount of 1.0 wt. % or more. Optionally, the erosion resistant alloy can be substantially free of aluminum.

Optionally the erosion resistant alloy can provide further improved properties based on the presence of at least one strengthening mechanism within the alloy, such as a carbide strengthening mechanism, a solid solution strengthening mechanism, a gamma prime strengthening mechanism, or a combination thereof. In some aspects, the strengthening mechanism can be formed in-situ due to exposure to reaction conditions within a reactor, such as pyrolysis conditions within a steam cracking reaction system or another type of pyrolysis reaction system.

BRIEF DESCRIPTION OF THE DRAWING

The FIGURE illustrates a schematic flow diagram of one type of pyrolysis furnace.

DETAILED DESCRIPTION

All numerical values within the detailed description and the claims herein are modified by "about" or "approximately" the indicated value, and take into account experimental error and variations that would be expected by a person having ordinary skill in the art.

Overview

In various aspects, reactor components formed using an erosion resistant alloy having desirable high temperature mechanical strength (heat resistant) are provided. The erosion resistant components can include, but are not limited to, tubes, reactors walls, fittings, and/or other components having surfaces that can be exposed to a high temperature reaction environment in the presence of hydrocarbons and/or that can provide pressure containment functionality (among other functionalities, if any) in processes for upgrading hydrocarbons in a high temperature reaction environment. This can include reaction environments in which carburization may occur, such as conduits for transporting or conveying hydrocarbon process streams which may be prone to coking. For example, an erosion resistant component can include, but is not limited to, any of the following members of a pyrolysis furnace: feed conduits; dilution steam conduits; steam cracker furnace tubes, such as convection tubes and/or radiant tubes, including those arranges in one or more coils; cross-over piping; transfer line exchangers; quench zone conduits; and other components in the pyrolysis process that may have one or more surfaces exposed to a hydrocarbon at a temperature exceeding 500° C. (930° F.).

The erosion resistant alloy used for forming the erosion resistant component can include 42.0 to 46.0 wt. % nickel; 32.1 to 35.2 wt. % chromium; 0.5 to 2.9 wt. % carbon; 0 to 2.0 wt. % titanium; 0 to 4.0 wt. % tungsten, and iron. It is noted the at least one of titanium and tungsten can be present in the alloy, so that at least one of titanium and tungsten is present in an amount of 1.0 wt. % or more. The iron can correspond to the balance of the composition. In some aspects, iron can correspond to 14.0 wt. % or more of the composition, or 16.0 wt % or more, such as up to 24.5 wt. %. In some aspects, the amount of carbon in the erosion resistant alloy can be 0.6 wt. % to 2.9 wt. %, or 0.8 wt. % to 2.9 wt. %, or 1.0 wt. % to 2.9 wt. %. Additionally or alternately, the erosion resistant alloy can be substantially free of aluminum.

Optionally but preferably, the erosion resistant alloy can provide further improved properties based on the presence of at least one strengthening mechanism within the alloy, such as a carbide strengthening mechanism, a solid solution strengthening mechanism, a gamma prime strengthening mechanism, or a combination thereof.

Conventionally, aluminum is added to many types of alloys in carburization environments to serve as an anti-coking agent within an alloy. By contrast, due to the improved properties of the erosion resistant alloy, the erosion resistant alloy described herein can be substantially free of aluminum while still providing beneficial performance in high temperature, carburizing environments. Being substantially free of aluminum can correspond to including no added aluminum in the alloy and/or having an aluminum content of less than 0.05 wt. %. With regard to including no added aluminum, some components for forming an alloy may potentially include aluminum impurities. It is understood that aluminum impurities within a desired component for forming an alloy are excluded when determining whether an alloy includes added aluminum.

Conventionally, many alloys for use in high temperature environments where erosion may occur can have a limited amount of carbon, such as less than 0.5 wt. %. The low amount of carbon in conventional alloys can be due in part to concerns regarding the formation of segregated portions of carbon within an alloy. By contrast, in some aspects the erosion resistant alloy described herein can take advantage of increased amounts of carbon to allow for increased strengthening due to formation of carbides. In some aspects, the amount of segregated carbon phases formed within the alloy can be reduced or minimized by using a hot-isostatic pressing method for forming a component from the alloy.

In some aspects, the erosion resistant alloy can be beneficial for facilitating formation of metal carbides ($M_xC_y$) throughout the thickness of the component during fabrication and/or during aging. For example, carbides corresponding to a stoichiometry of MC can form during fabrication while carbides corresponding to a stoichiometry of $M_3C_2$, $M_7C_3$, and/or $M_{23}C_6$ can form during aging. These carbides can provide high strength and hardness at high temperatures. Additionally or alternately, in aspects where titanium is included in the alloy, the formation of $Ni_3Ti$ within the alloy can provide a gamma prime strengthening mechanism. Further additionally or alternately, one or more elements can be added to the alloy that, in conjunction with the Ni in the alloy, provide a solid solution strengthening mechanism for the erosion resistant alloy.

Formation of an Erosion Resistant Component

The erosion resistant component made from an erosion resistant alloy can be formed by any convenient method of manufacture including hot-isostatic-pressing, sintering, centrifugal casting, static casting, extrusion, forging, rolling, joining, and/or machining. In some aspects, the method for manufacturing a component from an erosion resistant alloy can correspond to hot-isostatic pressing and equivalent methods. In such a method, a mixture of metal powders having the desired composition for the alloy can be formed into a shape by the hot-isostatic pressing process. Hot-isostatic pressing can potentially be beneficial for incorporating higher amounts of carbon into a component made from the erosion resistant alloy, while reducing or minimizing formation of segregated carbon portions in the alloy. Hot-isostatic pressing is a commercially available process. An exemplary hot-isostatic press apparatus and corresponding methods are described in U.S. Pat. No. 4,582,681, incorporated herein by reference with regard to the description of hot-isostatic pressing for component manufacture.

In some aspects, the manufacturing method, such as hot-isostatic pressing, can be used to make an erosion resistant component. In other aspects, the manufacturing method, such as hot-isostatic pressing, can be used to make a billet of the erosion resistant alloy, and the billet can then be used to make the erosion resistant component.

Erosion Resistant Alloy

A heat-resistant and erosion-resistant alloy can correspond to a chromium-nickel-iron alloy that also includes substantial amounts of carbon, chromium, iron, and at least one titanium and tungsten. In some aspects, the erosion resistant alloy can contain sufficient metal carbides to increase the hardness of the material at high temperatures. For example, the alloy can be capable of forming carbides under thermal cracking conditions. Such carbides can be beneficial for reducing erosion while maintaining hardness at high temperatures. Additionally or alternately, the erosion resistant alloy has at least one strengthening mechanism to provide desirable high temperature mechanical properties.

The erosion resistant alloy used for forming the erosion resistant component can include 42.0 to 46.0 wt. % nickel; 32.1 to 35.2 wt. % chromium; 0.5 to 2.9 wt. % carbon; 0 to 2.0 wt. % titanium; 0 to 4.0 wt. % tungsten, and iron. It is noted the at least one of titanium and tungsten can be present in the alloy, so that at least one of titanium and tungsten is present in an amount of 1.0 wt. % or more. The iron can correspond to the balance of the composition. In some aspects, iron can correspond to 14.0 wt. % or more of the composition, or 16.0 wt % or more, such as up to 24.5 wt. %. In some aspects, the amount of carbon in the erosion resistant alloy can be 0.6 wt. % to 2.9 wt. %, or 0.8 wt. % to 2.9 wt. %, or 1.0 wt. % to 2.9 wt. %. Additionally or alternately, the erosion resistant alloy can be substantially free of aluminum In some aspects, the alloy can contain a reduced or minimized amount of silicon. Without being bound by any particular theory, silicon is believed to decrease mechanical strength by serving as a deoxidizer. In some aspects, the erosion resistant alloy can include less than 1.0 wt. % silicon, such as down to substantially no silicon (i.e, less than 0.05 wt. %) and/or no added silicon. In this discussion, when the alloy has substantially no content of an element, it is understood that this corresponds to no intentional addition of the element to the alloy. However, trace amounts of such an element may be present, to the degree that such trace amounts may normally be present in the materials used for forming the alloy.

Manganese may be present in the erosion resistant alloy, such as to serve as an oxygen and/or sulfur scavenger when the alloy is in the molten state. When such scavenging functionality is desired, manganese can generally be present at a concentration of 1.5 wt. % or less, or 1.0 wt. % or less, or 0.5 wt. % or less, such as down to substantially no manganese and/or no added manganese. In some aspects, the alloy can include 0.1 wt % to 1.5 wt % manganese, or 0.5 wt % to 1.5 wt %, or 1.0 wt % to 1.5 wt %.

Boron may be present in the erosion resistant alloy, such as to improve grain boundary performance. Generally boron may be present in an amount of 0 to about 0.1 wt. %, or 0 to 0.07 wt. %, or 0 to 0.5 wt. %, or 0.05 wt % to 0.1 wt. %.

The erosion resistant alloy may optionally also include one or more rare-earth elements, i.e., the 15 elements of the lanthanide series ranging from lanthanum to lutetium in the Periodic Table, and yttrium and scandium, particularly cerium, lanthanum and neodymium. In such aspects, the one or more rare-earth elements can be present in an amount of about 0.005 to about 0.4 wt. %. In aspects where rare-earth elements are present, cerium, lanthanum and neodymium may form, in a combined amount, 80 wt. % or more of the total amount of the rare-earth elements, or 90 wt. % or more. Without being bound by any particular theory, it is believed that the presence of rare earth elements can contribute to the formation and stabilization of the alloy.

The high temperature, erosion resistant alloys described herein can also contain phosphorous, sulfur, and other impurities, such as those incorporated into the alloy when the material is prepared. The amount of such impurities can be comparable to or less than the amounts that are typical in conventional steam cracker alloys.

Strengthening Mechanisms

The erosion resistant alloy that makes up an erosion resistant component can include at least one strengthening mechanism to improve high temperature strength and hardness. An example of a suitable strengthening mechanism can be a carbides strengthening mechanism. The carbides strengthening mechanism can arise from precipitation of MC, $M_6C$, $M_7C_3$, and $M_{23}C_6$ type carbide phases where M is the metallic carbide forming element.

Conventionally, MC carbide can tend to occur as a large blocky carbide, random in distribution. $M_6C$ carbides can also tend to be blocky. However, when formed in grain boundaries as fine and discrete precipitates during metal processing, both MC and $M_6C$ can be used to control grain size and strengthen the alloy. $M_7C_3$ carbides, predominately $(Ti,Cr,Fe)_7C_3$, can form at grain boundaries and can be beneficial if precipitated as discrete particles since these carbides can reduce grain boundary sliding. $M_{23}C_6$ carbides can also show a propensity for grain boundary precipitation. Discrete grain boundary precipitates can enhance rupture strength.

In some aspects, an erosion resistant alloy can include a carbides strengthening mechanism based on the presence of metallic carbides formed from tungsten, titanium, chromium, or a combination thereof. The metallic carbides formed in the carbides strengthening mechanism can contain an amount of carbon that is dependent on the particular metals present in the carbides. A desired amount of carbon in the erosion resistant alloy having a carbides strengthening mechanism can include 0.5 wt. % to 2.9 wt. % carbon, or 0.6 wt. % to 2.9 wt. %, or 0.8 wt. % to 2.9 wt %, or 1.0 wt. % to 2.9 wt. %.

Another suitable strengthening mechanism can correspond to a gamma prime strengthening mechanism. Gamma prime (γ') strengthening mechanisms arise from precipitation of a $Ni_3Ti$ type gamma prime phase that can be formed during processing which involves alloy containing significant amount of Ni and Ti. The gamma prime phase being present in an erosion resistant alloy acts as a barrier to dislocation motion within the alloy crystal structure, and therefore increases the strength of the alloy due to its ordered nature and high coherency with the austenitic alloy matrix. In some aspects, a carburization resistant alloy can include gamma prime (y') strengthening mechanisms based on the alloy containing $Ni_3Ti$ and 0.5 wt. % to 2.9 wt. % carbon, or 0.6 wt. % to 2.9 wt. %, or 0.8 wt. % to 2.9 wt %, or 1.0 wt. % to 2.9 wt. %. In some aspects, the erosion resistant alloy comprises a) 42.0 to 46.0 wt. % nickel (Ni); b) 32.1 to 35.2 wt. % chromium (Cr); c) 0.5 to 2.9 wt. % carbon (C); d) 0 to 2.0 wt. % titanium (Ti); e) 0 to 4.0 wt. % tungsten (W); f) balance iron (Fe); and g) a gamma prime (y') strengthening mechanism corresponding to $Ni_3Ti$ and less than 2.9 wt. % carbon, with at least one of Ti and W being present in an amount of 1.0 wt. % or more.

Still another suitable strengthening mechanism can correspond to a solid solution strengthening mechanism. Solid solution strengthening mechanisms arise from differences in atomic diameter. For instance, Co, Fe, Cr, Mo, W, V, Ti, and Al are known to be solid solution strengtheners in Ni. In some aspects, Co, Fe, Cr, Mo, W, V, or Ti can be used as a solid solution strengthener, and preferably the solid solution strengthener can be Ti or Cr. These elements differ with Ni in atomic diameter from 1 to 13%. Therefore, lattice expansion related to atomic diameter oversize is related to the hardening. At thermal cracking operating temperatures, which is in the range of high temperature creep, strengthening is diffusion dependent. Therefore, relatively large and slow diffusing elements such as Ti, and Cr can be effective as hardeners. In some aspects, the erosion resistant alloy can include a solid solution strengthening mechanism based on at least one element selected from titanium, tungsten, iron, and chromium.

In some aspects, the erosion resistant alloy may include a combination of one or more of the aforementioned strengthening mechanisms. It is noted that due to the elevated amount of carbon in the alloy, the carbide strengthening mechanism can be more effective in the alloys described herein relative to conventional alloys. In some aspects, the erosion resistant alloy may comprise a carbides strengthening mechanism or at least one of (including combinations) gamma prime, and solid solution strengthening mechanism components.

In some aspects, the formation of one or more strengthening mechanisms in an erosion resistant alloy can be achieved by exposing the component to aging temperatures. Suitable aging temperatures for the controlled aging can be ≥about 815° C., e.g., 815° C. to 1200° C., or alternatively from 600° C. to 1100° C. Exposure times can be ≥about 1 hour, e.g., 1 hour to 500 hours, or from 1 hour to 300 hours, or from 1 hour to 100 hours. Additionally or alternately, some formation of strengthening mechanisms can occur during exposure of the component to a steam cracking environment.

The erosion resistant alloy can be beneficial for reducing or minimizing the amount of material lost from a component due to exposure of one or more surfaces of the component to an environment that can cause erosion, such as various locations within a steam cracking processing system. Erosion is a material removal process at a target surface by the action of streams and jets of solid particles or liquids. In most high temperature erosion environments, the eroding surface is undergoing corrosion as well as erosion. The erosion process is predominantly controlled by impingement variables such as erodent velocity, impingement angle, erodent flux, and temperature. It is also affected by erodent particle variables (i.e., size, shape, hardness, toughness, and density) and by target material variables (i.e., hardness, toughness, and elastic modulus). Kinetic energy transfer from erodent particles to the target surface causes degradation. The erosion rate of a generic material can be expressed by the following equation (1):

$$E \propto \frac{v_p^n * D_p^m * \rho_p^x}{(K_{IC})_t^{1.3} * H_t^y} \tag{1}$$

wherein $v_p$, $D_p$, and $\rho_p$ are the velocity, mean diameter, and density of impinging particles, respectively, and $K_{IC}$ and H are the toughness and hardness of the target material. The superscripts n, m, x, and y can be determined experimentally for a given system experiencing erosion. Thus, resistance to erosion requires high hardness and toughness of erosion resistant alloy. The components made of the erosion resistant alloy can therefore be manufactured from alloys having high hardness and/or toughness. Additionally, in an environment such as a steam cracking environment, good resistance to carburization and oxidation can be beneficial, due to the highly carburizing environment the components are exposed to during cracking conditions and/or due to the highly oxidizing environment the components are exposed to during the periodically required decoking operations.

The components made of the erosion resistant alloy described herein can be monolithic. The erosion resistance, referred to herein, lessens the component's tendency toward metal loss during decoking. The term "erosion resistant" in this context means that the alloy lessens the metal loss that results from coke particles impinging on the component when compared to other heat resistant alloys.

The word "monolithic" describes formation of the erosion resistant metal carbides and/or the presence of other strengthening mechanisms throughout a component, such as strengthening mechanisms that are distributed across more than 50% of the volume of the component, preferably over the entire volume of the component (i.e., distributed across more the 90% of the volume of the component). This can distinguish monolithic components made from the erosion resistant alloy from other systems that rely on a layer and/or surface treatments to provide erosion resistance.

Steam Cracking Furnace

High temperature components (tubes, fittings, nozzles) made from the erosion resistant alloy can be useful in various types of thermal cracking environments, such as a steam cracking environment for the production of ethylene, propylene, and/or other light olefins. In some aspects, systems and methods are provided for producing olefins based on pyrolyzing a hydrocarbon feed in a heat transfer tube composed of an erosion resistant alloy as described herein.

A non-limiting example of a steam cracking furnace is depicted in the FIGURE. In the example shown in the FIGURE, steam cracking furnace 1 includes a radiant firebox 103, a convection section 104 and flue gas exhaust 105. Fuel gas is provided via conduit 130 and control valve 101 to burners 102 that provide radiant heat to a hydrocarbon feed to produce the desired pyrolysis products by thermal cracking of the feed. The burners generate hot gas that flows upward through the convection section 104 and then away from the furnace via conduit 105.

In the example shown in the FIGURE, hydrocarbon feed is conducted via conduit 10 and valve 12 to at least one convection coil 13. Hydrocarbon feed introduced into convection coil 13 is preheated by indirect contact with hot flue gas. Valve 12 is used to regulate the amount of hydrocarbon feed introduced into convection coil 13. Convection coil 13 is typically one of a plurality of convection coils that are arranged in a first coil bank for parallel flow of hydrocarbon feedstock. Typically, a plurality of feed conduits 10 and 11 convey hydrocarbon feed to each of the parallel convection coils of the first coil bank. Four feed conduits are represented in the FIGURE, but any convenient number of feed conduits can be used. For example, convection sections having 3, 4, 6, 8, 10, 12, 16, or 18 feed conduits can be used for conveying (in parallel) portions of a total hydrocarbon feed to an equivalent number of convection coils located in the first coil bank. Although not shown, each of the plurality of feed conduits 11 may be provided with a valve (similar to valve 12). In other words, each of the plurality of conduits 11 can be in fluid communication with a convection coil (not shown) that (i) is located in the first coil bank and (ii) operates in parallel with convection coil 13. For simplicity, the description of the first convection coil bank will focus on convection coil 13. The other convection coils in the bank can be operated in a similar manner.

In the example shown in the FIGURE, dilution steam is provided via dilution steam conduit 20 through valve 22 to convection coil 23 for preheating by indirect transfer of heat from flue gas. Valve 22 is used to regulating the amount of dilution steam introduced into convection coil 23. Convection coil 23 is typically one of a plurality of convection coils that are arranged in a second coil bank for parallel dilution steam flow. Typically, a plurality of dilution steam conduits 20 and 21 convey dilution steam to each of the parallel convection coils of the second coil bank. Four dilution steam conduits are represented in the FIGURE, but any convenient number of dilution steam conduits can be used. For example, convection sections having 3, 4, 6, 8, 10, 12, 16, or 18 dilution steam conduits can be used for conveying (in parallel) portions of an amount of total dilution steam to an equivalent number of convection coils located in the second convection coil bank. Although not shown, each of the plurality of dilution steam conduits 21 may be provided with a valve (similar to valve 22). In other words, each of the plurality of conduits 21 is in fluid communication with a convection coil (not shown) operating in parallel with convection coil 23. For simplicity, the description of the second convection coil bank will focus on coil 23. The other convection coils in the bank can be operated in a similar manner.

In the example shown in the FIGURE, preheated dilution steam and preheated hydrocarbon feed are combined in or proximate to conduit 25. The hydrocarbon and steam mixture is reintroduced into convection section 104 via conduit(s) 25, for preheating of the hydrocarbon and steam mixture in convection coil 30. Convection coil 30 is typically one of a plurality of convection coils that are arranged in a third coil bank for parallel flow of the hydrocarbon and steam mixture during pre-heating. One convection coil for pre-heating hydrocarbon and steam mixture is represented in the FIGURE, but any convenient number of such convection coils can be used. For example, a third coil bank having 3, 4, 6, 8, 10, 12, 16, or 18 hydrocarbon and steam mixture convection coils can be used for conveying (in parallel) portions of a total amount of hydrocarbon and steam mixture. For simplicity, the description of the third convection coil bank will focus on coil 30. The other convection coils in the bank can operate in a similar manner. The hydrocarbon and steam mixture can be preheated in convection coil 30 to, for example, a temperature in the range of from ~750° F. to 1400° F. (~400° C. to ~760° C.).

Cross-over piping 31 is used for conveying the preheated hydrocarbon and steam mixture to radiant coil 40 in radiant section 103 for thermal cracking of the hydrocarbon. Radiant coil 40 can be one of a plurality of radiant coils (the others are not shown), which together constitute a bank of radiant coils in radiant section 103. The temperature of the heated mixture exiting conduit 30 is generally designed to be at or near the point where significant thermal cracking commences. Process conditions, such as the amount of feed pre-heating in convection coil 13, the amount of steam pre-heating in convection coil 23, the amount of hydrocarbon and steam mixture pre-heating in convection coil 30, the relative amount of hydrocarbon feed and dilution steam, the temperature, pressure, and residence time of the preheated hydrocarbon and steam mixture in radiant coil 40, and the duration of the first time interval (the duration of pyrolysis mode in coils 13, 23, 30, and 40) typically depend on the composition of the hydrocarbon feed, yields of desired products, and the amount of coke accumulation in the furnace (particularly in radiant coils) that can be tolerated. Heat transfer tubes composed of an erosion resistant alloy as described herein can be useful as radiant coils 40.

After the desired degree of thermal cracking has been achieved in the radiant section 103, the furnace effluent can be rapidly cooled in cooling stage 50. Any method of cooling the furnace effluent may be used. In one aspect, cooling stage 50 includes at least a primary transfer line exchanger (TLE). For hydrocarbon feeds which contain liquid hydrocarbon, e.g., heavier naphthas and all gas-oil feeds, a direct oil quench connection can be used downstream of the primary TLE. The oil quench connection allows addition of quench oil into the pyrolysis product stream to provide heat transfer from the product stream directly to the injected quench oil. For this purpose, a quench medium, such as quench oil, can be injected into the effluent via at least one fitting adapted for this purpose. Additional quenching stages can be utilized in cooling stage 50, and these stages can be operated in series, parallel, or series-parallel. Cooled furnace effluent exits via conduit 51 for further separation and/or processing, e.g., for removing ethylene and/or propylene from the furnace effluent. Besides or in addition to their use in the steam cracking furnace, the specified weldments can be utilized in one or more TLE's or quench stages thus described. More generally, any convenient method of cooling the furnace effluent can be used.

Hydrocarbon Feeds

Heat transfer tubes formed from an erosion resistant alloy as described herein may be used for conveying substantially any hydrocarbon-containing feed that can produce light olefins by steam cracking. In certain aspects, the hydrocarbon feed can correspond to a feedstock including relatively high molecular weight hydrocarbons ("Heavy Feedstocks"), such as those which produce a relatively large amount of SCT during steam cracking. Examples of Heavy Feedstocks include one or more of steam cracked gas oil and residues, gas oils, heating oil, jet fuel, diesel, kerosene, coker naphtha, steam cracked naphtha, catalytically cracked naphtha, hydrocrackate, reformate, raffinate reformate, Fischer-Tropsch liquids, Fischer-Tropsch gases, distillate, crude oil, atmospheric pipestill bottoms, vacuum pipestill streams including bottoms, wide boiling range naphtha to gas oil condensates, heavy non-virgin hydrocarbon streams from refineries, vacuum gas oils, heavy gas oil, naphtha contaminated with crude, atmospheric residue, heavy residue, $C_4$/residue admixture, naphtha/residue admixture, gas oil/residue admixture, and crude oil. The hydrocarbon can have a nominal final boiling point of at least about 600° F. (315° C.), generally greater than about 950° F. (510° C.), typically greater than about 1100° F. (590° C.), for example greater than about 1400° F. (760° C.). Nominal final boiling point means the temperature at which 99.5 wt. % of a particular sample has reached its boiling point.

In another aspect, the hydrocarbon feed can contain naphtha as a major component (Naphtha Feedstocks). Naphtha Feedstocks can comprise a mixture of $C_5$ to $C_{10}$ hydrocarbons, for example $C_5$ to $C_8$ aliphatic hydrocarbons.

In other aspects, the hydrocarbon feed can include one or more relatively low molecular weight hydrocarbon (Light Feedstocks), particularly those aspects where relatively high yields of $C_2$ unsaturates (ethylene and acetylene) are desired. Light Feedstocks typically include substantially saturated hydrocarbon molecules having fewer than five carbon atoms, e.g., ethane, propane, and mixtures thereof. The heat transfer tubes of the invention are particularly useful for steam cracking Light Feedstock, and more particularly as radiant tubes for the steam cracking of ethane.

Test Methods

Chemical composition may be determined by electron probe micro-analyzer (EPMA). EPMA is fundamentally the same as scanning electron microscopy (SEM) with the added capability of chemical analysis. The primary importance of EPMA is the ability to acquire precise, quantitative elemental analyses by wavelength dispersive spectroscopy (WDS). The spatial scale of analysis, combined with the ability to create detailed images of the sample, makes it possible to analyze materials in situ and to resolve complex chemical variation within single phases.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

What is claimed is:

1. A furnace component composed of an erosion resistant alloy, the erosion resistant alloy comprising a) 42.0 to 46.0 wt. % nickel (Ni); b) 32.1 to 35.2 wt. % chromium (Cr); c) 0.5 to 2.9 wt. % carbon (C); d) 0 to 2.0 wt. % titanium (Ti); e) 0 to 4.0 wt. % tungsten (W); f) balance iron (Fe), wherein the erosion resistant alloy comprises 1.0 wt. % or more of at least one of Ti and W, and wherein the erosion resistant alloy comprises less than 0.05 wt. % aluminum.

2. The furnace component of claim 1, wherein the erosion resistant alloy comprises at least one strengthening mechanism, the at least one strengthening mechanism comprising:

(i) a carbides strengthening mechanism, wherein the erosion resistant alloy comprises carbides of at least one of titanium, tungsten, and chromium;

(ii) a gamma prime (γ') strengthening mechanism, wherein the erosion resistant alloy comprises $Ni_3Ti$;

(iii) a solid solution strengthening mechanism; or (iv) a combination of two or more of (i), (ii), and (iii).

3. The furnace component of claim 1, wherein the erosion resistant alloy comprises 14 wt. % or more of Fe.

4. The furnace component of claim 1, wherein the furnace component comprises a feed conduit, a dilution steam conduit, a convection tube, a radiant tube, a radiant coil, a pipe, a transfer line exchanger, a quench zone conduit, or a combination thereof.

5. The furnace component of claim 1, wherein the furnace component comprises a steam cracker furnace component.

6. The furnace component of claim 1, wherein the furnace component comprises 1.0 wt. % carbon or more.

7. The furnace component of claim 1, wherein the furnace component comprises a monolithic structure.

8. A method for producing a furnace component, comprising:

forming a furnace component comprising an erosion resistant alloy via hot-isostatic-pressing, sintering, centrifugal casting, static casting, extrusion, forging, rolling, joining, machining, or a combination thereof, wherein the erosion resistant alloy comprises a) 42.0 to 46.0 wt. % nickel (Ni); b) 32.1 to 35.2 wt % chromium (Cr); c) 0.5 to 2.9 wt. % carbon (C); d) 0 to 2.0 wt. % titanium (Ti); e) 0 to 4.0 wt. % tungsten (W); f) balance iron (Fe), wherein the erosion resistant alloy comprises 1.0 wt. % or more of at least one of Ti and W, wherein the erosion resistant alloy comprises less than 0.05 wt. % aluminum.

9. The method of claim 8, wherein the erosion resistant alloy comprises at least one strengthening mechanism, the at least one strengthening mechanism comprising:

(i) a carbides strengthening mechanism, wherein the erosion resistant alloy comprises carbides of at least one of titanium, tungsten, and chromium;

a gamma prime (γ') strengthening mechanism, wherein the erosion resistant alloy comprises $Ni_3Ti$;

(iii) a solid solution strengthening mechanism; or (iv) a combination of two or more of (i), (ii), and (iii).

10. The method of claim 8, wherein forming the furnace component comprises:

forming a billet comprising the erosion resistant alloy; and forming the furnace component from the billet.

11. The method of claim 8, wherein forming the furnace component comprises forming the furnace component via hot-isostatic pressing.

12. The method of claim 8, wherein the erosion resistant alloy comprises 14 wt. % or more of Fe.

13. The method of claim 8, wherein the furnace component comprises 1.0 wt. % carbon or more.

14. The method of claim 8, wherein the furnace component comprises a feed conduit, a dilution steam conduit, a convection tube, a radiant tube, a radiant coil, a pipe, a transfer line exchanger, a quench zone conduit, or a combination thereof.

15. The method of claim 8, wherein the furnace component comprises a monolithic structure.

16. A method for producing olefins, comprising pyrolyzing a hydrocarbon feed in a pyrolysis environment comprising a furnace component, the furnace component comprising an erosion resistant alloy, wherein the erosion resistant alloy comprises a) 42.0 to 46.0 wt, % nickel (Ni); b) 32.1 to 35.2 wt. % chromium (Cr); c) 0.5 to 2.9 wt. % carbon (C); d) 0 to 2.0 wt. % titanium (Ti), e) 0 to 4.0 wt. % tungsten (W); f) balance iron (Fe), wherein the erosion resistant alloy comprises 1.0 wt. % or more of at least one of Ti and W.

17. The method of claim 16, wherein the erosion resistant alloy comprises at least one strengthening mechanism, the at least one strengthening mechanism comprising:

(i) a carbides strengthening mechanism, wherein the erosion resistant alloy comprises carbides of at least one of titanium, tungsten, and chromium;

(ii) a gamma prime (γ') strengthening mechanism, wherein the erosion resistant alloy comprises $Ni_3Ti$;

(iii) a solid solution strengthening mechanism; or (iv) a combination of two or more of (i), (ii), and (iii).

18. The method of claim 16, wherein the method of pyrolyzing a hydrocarbon feed comprises steam cracking, or wherein the pyrolysis environment comprises a steam cracking environment, or a combination thereof.

19. The method of claim 16, wherein the erosion resistant alloy comprises less than 0.05 wt. % aluminum.

20. The method of claim 16, wherein the erosion resistant alloy comprises 14 wt. % or more of Fe.

21. The method of claim 16, wherein the furnace component comprises 1.0 wt. % carbon or more.

22. The method of claim 16, wherein the furnace component comprises a feed conduit, a dilution steam conduit, a convection tube, a radiant tube, a radiant coil, a pipe, a transfer line exchanger, a quench zone conduit, or a combination thereof.

23. The method of claim 16, wherein the furnace component comprises a monolithic structure.

24. The furnace component of claim 1, wherein the erosion resistant alloy comprises 1.0 to 2.9 wt. % C.

25. The furnace component of claim 1, wherein forming the furnace component comprises forming the furnace component via hot-isostatic pressing.

* * * * *